US005282327A

United States Patent [19]

Ogle

[11] Patent Number: 5,282,327

[45] Date of Patent: Feb. 1, 1994

[54] PIVOTAL HEEL FOR FOOTWEAR

[76] Inventor: Estel E. Ogle, 270 Rosehill Dr., Christiansburg, Va. 24073

[21] Appl. No.: 18,222

[22] Filed: Feb. 16, 1993

[51] Int. Cl.[5] ..... A43B 11/00

[52] U.S. Cl. ..... 36/138; 36/105

[58] Field of Search ..... 36/138, 7.8, 50.5, 100, 36/105, 120

[56] References Cited

U.S. PATENT DOCUMENTS

| | | | |
|---|---|---|---|
| 2,452,502 | 10/1948 | Tarbox | 36/87 |
| 2,452,649 | 11/1948 | Graves | 36/138 |
| 2,815,588 | 12/1957 | Ruane | 36/138 |
| 3,146,535 | 9/1964 | Owings | 36/7.3 |
| 4,457,084 | 7/1984 | Horibata et al. | 36/7.8 |
| 4,724,626 | 2/1988 | Baggio | 36/50.5 X |
| 5,127,170 | 7/1992 | Messina | 36/105 |

FOREIGN PATENT DOCUMENTS

| | | | |
|---|---|---|---|
| 3629292 | 3/1988 | Fed. Rep. of Germany | 36/138 |

*Primary Examiner*—Paul T. Sewell
*Assistant Examiner*—Beth Anne C. Cicconi
*Attorney, Agent, or Firm*—Richard C. Litman

[57] ABSTRACT

A shoe has a retractable heel which is normally latched in an upright position and spring biased into an inclined position. A wearer's foot, when the shoe is donned, acts on a floor member, forcing the heel section into the upright position, causing the heel section to latch to the shoe. The shoe is thus maintained in the donned state, and grips the foot without laces or other attachment devices. A release mechanism is operated by a rod projecting from the rear of the shoe. Release is actuated by moving the shoe rear end against any solid object, thus depressing the release rod. A wearer thus dons the shoe by stepping into it, and releases the heel in order to doff the shoe by manipulating the shoe by foot. Thus, a wearer does not need to use his or her hands either to don or doff the shoe.

11 Claims, 3 Drawing Sheets

PIVOTAL HEEL FOR FOOTWEAR

BACKGROUND OF THE INVENTION

1. Field of the Invention

The present invention relates to a shoe having a tiltable or inclining heel, the heel of the shoe being tilted about a pivot point on demand by a release mechanism.

2. Description of the Prior Art

Shoes having hinged heel wall sections are known, as exemplified by U.S. Pat. Nos. 2,452,502, issued to J. P. Tarbox on Oct. 26, 1948; 2,452,649, issued to C. H. Graves on Nov. 2, 1948; and 3,146,535, issued to C. W. Owings on Sep. 1, 1964. Tarbox provides latching of the heel wall section, and a finger operated release. Graves provides a spring constantly biasing the hinged heel to a tilted position. The heel is retained in an upright position by the wearer's foot. Owings spring biases the heel wall section into the upright position. The shoe includes a latching arrangement to maintain the heel section in the upright position. The heel section is released by pushing downwardly on the heel, thus causing relative pivoting between the heel and the rest of the shoe.

Graves's invention does not positively latch the heel section in the upright position. Tarbox and Owings require manipulation by hand to release the heel for removal of the shoe.

None of the above inventions and patents, taken either singly or in combination, is seen to describe the instant invention as claimed.

SUMMARY OF THE INVENTION

The present invention provides a shoe which can be donned and doffed without requiring the wearer to use his hands. This shoe is therefore suitable for those who are incapacitated to the extent that they cannot reach their feet with their hands, or have lost the use of their hands. A pivotable heel section of the shoe is spring urged into a retracted, or inclined, position. A wearer dons the shoe, his or her foot forcing the heel section into a normal, or upright position, in which position the heel section latches. A release mechanism is operated by a push rod which projects from the rear of the shoe. When the wearer moves the rear of the shoe against a solid or fixed object, the push rod is depressed. The heel section then springs into the inclined position, allowing the foot to be easily withdrawn from the shoe.

Accordingly, it is a principal object of the invention to provide a shoe having a pivotable heel which is operated by a wearer's feet.

It is another object of the invention to provide a shoe having a pivotable heel which is biased to an inclined position and which latches in an upright position.

It is a further object of the invention to provide a shoe having a retractable heel which is released by depressing a push rod projecting externally from the shoe.

Still another object of the invention is to provide a shoe having a pivotable heel which includes a first latch component mounted to the pivotable heel and a cooperating second latch component mounted to the sole.

It is a further object of the invention to provide a shoe having a pivotable heel which has a dust cover to exclude dust, dirt, and sand from the working components of the pivotable heel.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
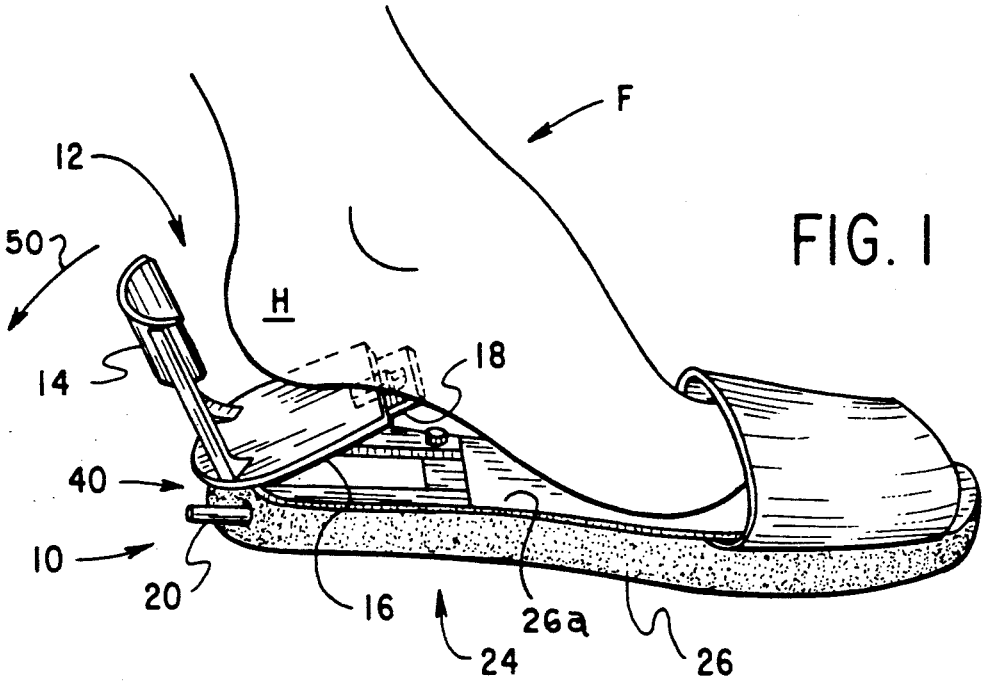
FIG. 1 is an environmental perspective view of the invention showing a heel section inclined to enable ingress of a wearer's foot into the shoe.

The present invention is seen in FIG. 1 to comprise a shoe 10 having a heel section 12 which tilts backwardly as shown by arrow 50 to an inclined position. The heel section 12 includes a rear wall 14 which contacts and supports the heel H of a wearer, maintaining the shoe 10 on the wearer's foot F, and a floor portion 16 having an extension 18. When a wearer inserts his or her foot F into the shoe 10, the wearer's weight bears downwardly on the floor portion 16, thus causing the heel section 12 to tilt forwardly into an upright position, where it is secured by a latching arrangement. The upright position is generally disposed similarly to the normal position of a conventional shoe (not shown), in which the rear wall contacting the wearer's heel does not tilt backwards. Hereinafter, this normal position will be referred to as an upright position, and the retracted state, as illustrated in FIG. 1, will be referred to as the inclined position.

Figure 2:
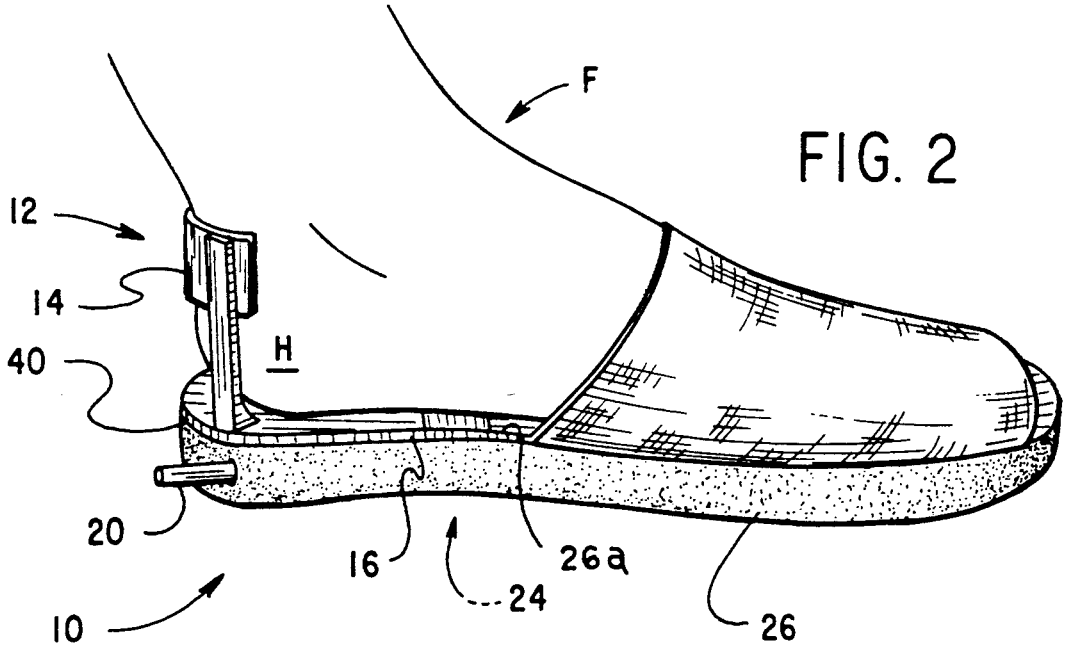
FIG. 2 is an environmental perspective view of the invention showing the heel section in its normal, or upright, position.

The upright position is shown in FIG. 2, a push rod 20 projecting rearwardly from the shoe 10 also being visible. When the heel section 12 is in the upright position, the floor portion 16 is located adjacent an insole portion 26*a* of the shoe 10. The push rod 20 releases the latching arrangement maintaining the heel section 12 in the upright position. The heel section 12 then assumes the inclined position in response to a spring bias, thereby separating the floor portion 16 from the insole 26*a*.

Figure 3:
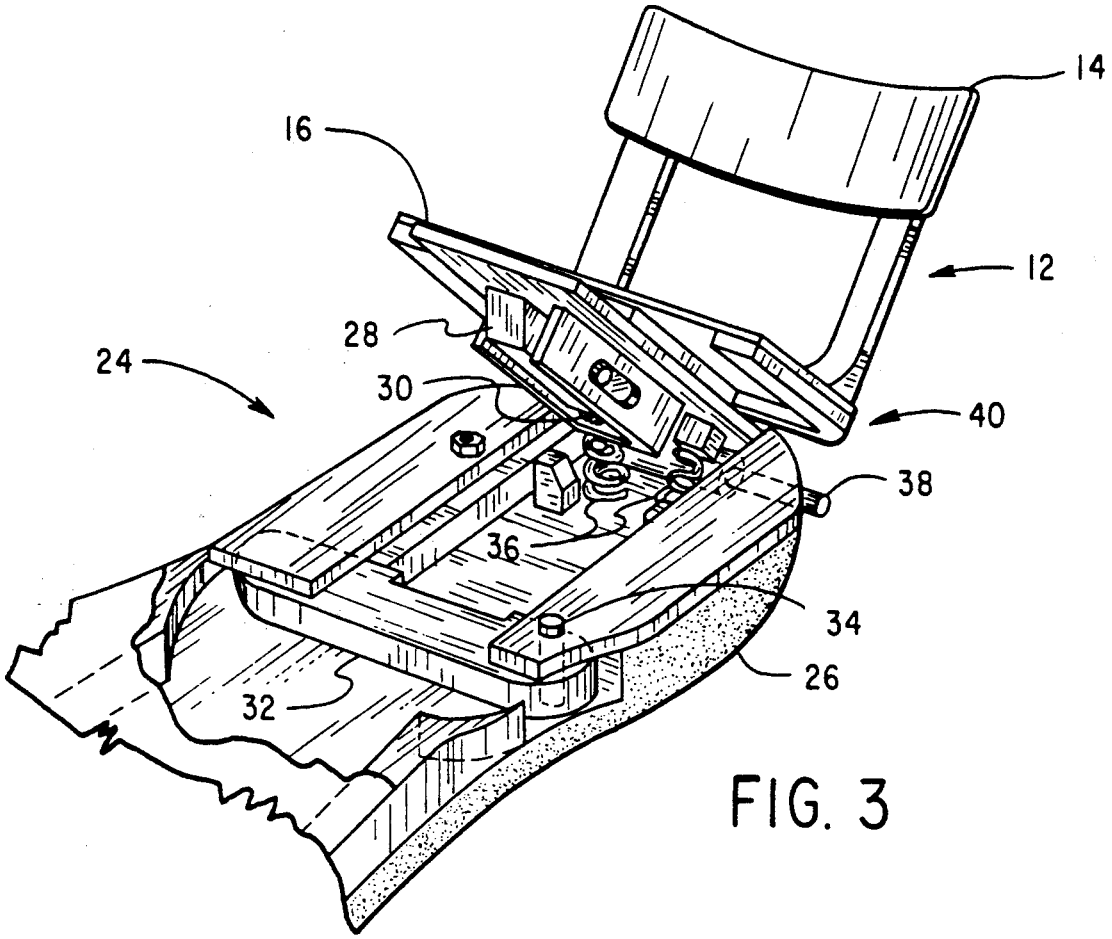
FIG. 3 is a perspective detail view, partially broken away, showing the heel section in a tilted, or inclined, position.

Components enabling the heel section 12 to perform as described herein are located substantially in a chamber 24 formed beneath the heel section 12 and in the sole 26 of the shoe 10. Turning to FIG. 3, it will be seen that the heel floor portion 16 includes a sliding tongue 28 biased forwardly by a latch tongue spring 30. This tongue 28 engages a latch member 32 which is pivotally attached to the sole 26 at pivot 34, and pivots between a latching position and a released position. Also visible are springs 36 mounted on the sole 26 which exert an upward bias on the heel section 12. In response to springs 36, heel section 12 pivots about a bar 38 which is also secured to the sole 26, thus moving to the inclined position when not constrained by the latching arrangement. This bar 38 is visible at the rear 40 of the shoe 10.

Figure 4:
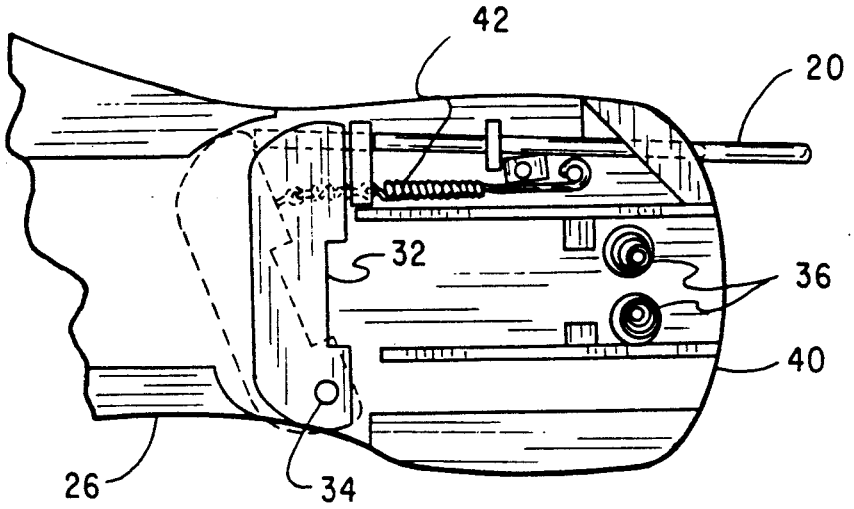
FIG. 4 is a top plan detail view, partially broken away, showing components which are attached to the sole.

Action of the push rod 20 in releasing the latching arrangement is now explained, with reference to FIG. 4. When depressed, as by moving the shoe 10 rearwardly against a solid or fixed object (not shown), push rod 20 pushes on the latch member 32, overcoming a return spring 42. The latch member 32 then pivots to the released position shown in dash lines, disengaging tongue 28. The heel section 12 is thus freed to respond to springs 36, and thereby assume the inclined position. Return spring 42 moves the latch member 32 back into the latching position, shown in solid lines, and also returns push rod 20 to its original position.

The wearer's foot F is prevented from access to chamber 24 by extension 18, which covers the workings of the shoe 10, and thus protects the latch tongue 28 from damage from solid objects impinging thereagainst. To this end, extension 18 is formed from a suitable strong and rigid material, such as metal, wood, or a suitable plastic.

Figure 5:
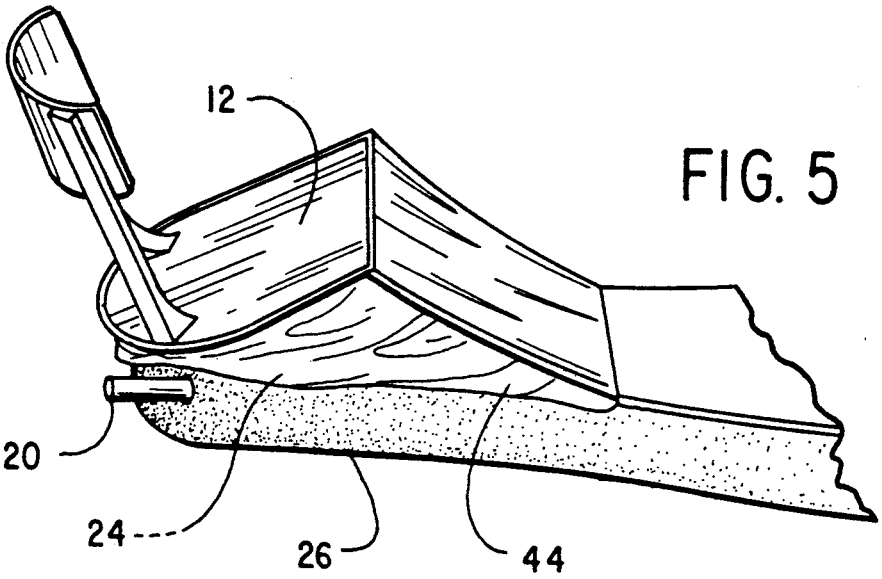
FIGS. 5 and 6 are perspective detail views showing an alternative embodiment of the invention, with the heel section in the inclined and upright positions, respectively.
Figure 6:
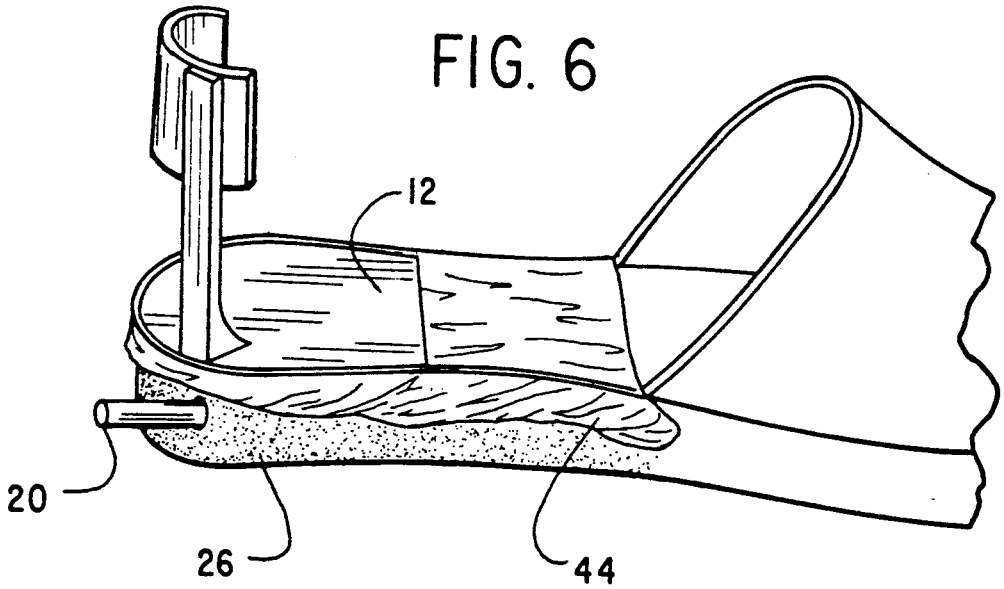

Further protection, principally against sand, dust, and the like is provided by a protective membrane 44, illustrated in FIGS. 5 and 6. In this alternative embodiment, protective membrane 44 seals chamber 24. The membrane 44 is preferably formed from a flexible, elastic sheet of material which is attached to sole and heel section so as to provide a continuous, impenetrable cover protecting chamber 24 whether heel section 12 is in the upright or in the inclined position. This embodiment is preferred when using the novel shoe 10 at a seashore and in similar environments (not shown).

A shoe 10 having a tiltable heel which can be donned and doffed without requiring the use of a wearer's hands is thus provided.

It is to be understood that the present invention is not limited to the embodiments described above, but encompasses any and all embodiments within the scope of the following claims.

I claim:

1. A shoe having a sole, an insole, a rear end, and a heel section mounted on said shoe and pivotal between an inclined position and an upright position, said shoe further comprising:

latching means for maintaining said heel section in said upright position, heel section biasing means for biasing said heel section into said inclined position with respect to said sole, whereby said shoe is readily donned when not being worn, and release means for releasing said heel section from said upright position and enabling said heel section to pivot to said inclined position in response to said heel section biasing means, thereby separating said heel section from said insole, said release means including a release member projecting externally from said shoe rear end, whereby said release means is operated by pushing said shoe rear end against a solid object, the use of a wearer's hands thus being rendered unnecessary in donning and removing said shoe.

2. The shoe according to claim 1, said latching means of said shoe further including a latch member for selectively engaging or disengaging said heel section, said latch member being pivotally mounted on said sole, pivotable between a latching position for engaging said heel section and a released position for disengaging said heel section, and having latch biasing means for biasing said latch member to said latching position, said latch biasing means also mounted on said sole.

3. The shoe according to claim 2, said heel section further including a latch tongue attached to the front end of said floor portion of said heel section and a latch tongue biasing means for biasing said latch tongue into a position engaging said latch member, said latch member including a first end thereof at which said pivot is located and a second end thereof, opposite said first end thereof, to which said latch biasing means is attached so as to maintain said latch member in said latching position, thus immobilizing said heel section in said upright position.

4. The shoe according to claim 3, wherein said release member includes a push rod engageable with said first end of said latch member so as to push said first end of said latch member, thereby forcing said latch member to pivot to said released position, whereby said release means is operated by pushing said shoe rear end against a solid object so as to force said push rod to push said first end of said latch member, the use of a wearer's hands thus being rendered unnecessary in donning and removing said shoe.

5. The shoe according to claim 1, said heel section further comprising means for covering said latching means when said heel section is in an upright position, said means for covering said latching means comprising a rigid material, whereby said latching means is protected from damage from solid objects impinging thereagainst.

6. The shoe according to claim 1, further comprising means for excluding sand and dust from said latching means, said heel section biasing means, and said release means.

7. The shoe according to claim 6, said means for excluding sand and dust comprising a flexible, elastic sheet of material attached to said sole and to said heel section as to provide a continuous, impenetrable cover.

8. A shoe having a sole, a rear end, and a tiltable heel section pivotally mounted on said shoe and pivotable between an upright and an inclined position, said shoe comprising:

latching means for maintaining said heel section in said upright position, said latching means comprising at least a latch member mounted on said sole and pivotable between a latching position and a released position, and latch member biasing means for biasing said latch member to pivot to said latching position, and a latch tongue and latch tongue biasing means for biasing said latch tongue into a position for engaging said latch member, wherein said latch tongue engages said latch member as said shoe is donned whereby donning of said shoe causes said latch member to pivot to said latching position by overcoming the tension of said latch member biasing means whereby said latch tongue engages said latch member, said latch tongue being immobilized when engaging said latch member, and thereby maintaining said heel section in said upright position, said latch tongue and latch tongue biasing means being disposed upon said heel section, heel section biasing means for releasing said heel section when in said upright position, thereby enabling said heel section to backwardly pivot toward said rear end of said shoe, placing said heel section in said inclined position, release means for releasing said heel section when in said upright position, thereby enabling said heel section to pivot to said inclined position in response to a push rod means for projecting externally from said shoe rear end and engageable with said latch member so as to push said latch member into said released position, whereby said release means is operated by pushing said shoe rear end against a solid object, the use of a wearer's hands thus being rendered unnecessary in donning and removing said shoe, means for covering said latching means when said heel section is in an upright position, said means for covering said latching means comprising at least a rigid material, and means for excluding sand and dust from said latching means, said heel section biasing means, and said release means.

9. The shoe according to claim 8, said means for excluding sand and dust comprising a flexible, elastic sheet of material attached to said sole and to said heel section as to provide a continuous, impenetrable cover.

10. A shoe having a sole, a rear end, and a tiltable heel section mounted on said shoe and pivotal between an inclined position and an upright position, said tiltable heel section including a floor portion having a front end and a back end, said back end including a rear wall extending upwardly therefrom for supporting the heel of the wearer, and said front end being located adjacent said insole, said shoe further comprising:

latching means for maintaining said heel section in said upright position, said latching means including a latch member mounted on said sole and a pivot for pivoting said latch member between a latching position and a released position, said latch member including a latch member biasing means for biasing said latch member toward said latching position, said latch member biasing means also mounted on said sole, heel section biasing means for biasing said heel section toward said inclined position, releasing means for releasing said heel section from said upright position so said heel section pivots to said inclined position, said releasing means including a projecting member extending externally from said shoe rear end, whereby said releasing means is operated by pushing said shoe rear end against a solid object.

11. A sole according to claim 10, further comprising an insole connected to said sole, said heel section biasing means further configured so said heel section separates from insole when said heel section pivots backwardly toward the rear end of said shoe.

* * * * *